US009651303B2

(12) United States Patent
Vinyard et al.

(10) Patent No.: US 9,651,303 B2
(45) Date of Patent: May 16, 2017

(54) CURING OVEN FOR PRINTED SUBSTRATEES

(71) Applicants: Ronald G Vinyard, Pacific, MO (US); John Vinyard, Ballwin, MO (US)

(72) Inventors: Ronald G Vinyard, Pacific, MO (US); John Vinyard, Ballwin, MO (US)

(73) Assignee: BBC Industries, Inc., Pacific, MO (US)

( * ) Notice: Subject to any disclaimer, the term of this patent is extended or adjusted under 35 U.S.C. 154(b) by 56 days.

(21) Appl. No.: 14/545,340

(22) Filed: Apr. 23, 2015

(65) Prior Publication Data

US 2015/0308740 A1 Oct. 29, 2015

Related U.S. Application Data

(60) Provisional application No. 61/996,057, filed on Apr. 25, 2014.

(51) Int. Cl.
*F26B 3/30* (2006.01)
*F27B 9/16* (2006.01)

(52) U.S. Cl.
CPC . *F26B 3/30* (2013.01); *F27B 9/16* (2013.01)

(58) Field of Classification Search
CPC ..... F26B 3/00; F26B 3/30; F27B 9/00; F27B 9/16
USPC ..... 34/167; 432/8, 59
See application file for complete search history.

(56) References Cited

U.S. PATENT DOCUMENTS 1,399,415 A * 12/1921 Lucien ..... F26B 15/085 34/242
2,800,725 A * 7/1957 Holes ..... B29D 7/00 34/624
3,228,113 A * 1/1966 Fannon, Jr. ..... F26B 3/283 118/61
3,829,982 A * 8/1974 Pray ..... F26B 3/28 34/277
4,028,051 A 6/1977 Lundstrom
4,216,591 A * 8/1980 Bubley ..... F26B 3/283 34/421
4,603,491 A 8/1986 Hengle et al.
4,694,180 A 9/1987 Salisbury et al.
4,717,339 A 1/1988 Kersting
4,825,561 A 5/1989 Cornell
4,882,853 A * 11/1989 Schaft ..... B05D 3/02 34/275
5,018,966 A 5/1991 Braun
5,033,203 A 7/1991 Chang et al.
5,321,896 A * 6/1994 Brownewell ..... B05D 3/0209 118/58
D360,423 S 7/1995 Neal
5,570,633 A * 11/1996 Schultz ..... B41F 13/12 101/182
5,655,312 A * 8/1997 Sevcik ..... B41F 23/0409 34/275
5,730,048 A * 3/1998 Averill ..... B41F 5/24 101/37

(Continued)

*Primary Examiner* — Stephen M Gravini
(74) *Attorney, Agent, or Firm* — Paul M. Denk

(57) ABSTRACT

An oven and method for curing inks on various substrates and textiles, such as clothing or shirts, conveyed by an overhanging vertically oriented chain conveyor. Clips are attached to the chain conveyor for holding the printed textile in a vertical oven mount, as they pass by the radiant heating elements structured in the curing oven during usage.

15 Claims, 3 Drawing Sheets

(56) References Cited

U.S. PATENT DOCUMENTS

| | | | | |
|---|---|---|---|---|
| 5,901,462 | A * | 5/1999 | Rudd | F26B 13/14 34/122 |
| 6,088,931 | A * | 7/2000 | Aylor | B41F 23/0413 34/267 |
| 6,161,304 | A * | 12/2000 | Iaccino | F26B 21/004 34/208 |
| 6,267,587 | B1 | 7/2001 | Bishop et al. | |
| 6,394,796 | B1 | 5/2002 | Smith | |
| 6,920,704 | B1 * | 7/2005 | Silverbrook | B41J 11/002 101/483 |
| 6,944,970 | B2 * | 9/2005 | Silverbrook | F26B 13/102 101/389.1 |
| 7,363,729 | B2 * | 4/2008 | Tanaka | F26B 3/28 205/333 |
| 8,038,436 | B2 | 10/2011 | Rogers, Jr. et al. | |
| 8,904,668 | B2 * | 12/2014 | Priebe | F26B 3/22 101/450.1 |
| 8,984,764 | B2 * | 3/2015 | Rae | B41F 23/0409 101/424.1 |
| 2008/0193890 | A1 | 8/2008 | Rogers | |
| 2009/0220905 | A1 | 9/2009 | McGowan | |
| 2010/0119985 | A1 | 5/2010 | Potterill et al. | |
| 2015/0308740 | A1 * | 10/2015 | Vinyard | F27B 9/16 34/273 |

* cited by examiner

CURING OVEN FOR PRINTED SUBSTRATEES

CROSS REFERENCE TO RELATED APPLICATION

This non-provisional patent application claims priority to the provisional application having Ser. No. 61/996,057, filed on Apr. 25, 2014.

FIELD OF THE INVENTION

This invention generally relates to a heating system or curing oven that can cure printed inks that have been applied to textiles, such as shirts, jackets, or the like, wherein the textiles are conveyed through the oven and clipped into position for passage by its radiant heating elements to achieve the drying, hardening, and curing process.

Textiles are typical substrates that can be cured in the oven. But the oven invention can accommodate a variety of substrates and the application of the invention is not limited to textiles. Throughout this patent textiles and substrates will be used interchangeably.

BACKGROUND OF THE INVENTION

Since the development and application of rotary screen printing presses in the 1960's, belt driven conveyor ovens have been used to fully cure screen printed inks onto textiles. Current screen printing ovens heat a flat-laying printed textile with the image facing up on a moving belt, normally arranged in a flattened or horizontal configuration, with a heat source being arranged thereabove, and utilizing either radiation and/or convention means for curing of the applied inks. Oven chambers can vary in many ways, and in sizes, but the horizontal orientation of the heat source and the substrate to which the heat is applied has generally remained the same.

Two main types of energy powering current ovens is one formed operating from electricity, and the other is from gas combustion. Energy efficiency is an important feature for the oven owners. Particularly where gas combustion is used, energy loss can be significant. And, controlling energy loss is a constant battle for the oven manufacturers, and particularly their customers, especially regarding paying the utility bills to operate and run these systems. Energy loss can be extensive and difficult to measure, but should be defined as the total energy consumed less the energy transferred to the printed textile. In the case of today's electrically powered radiant heaters positioned above the textile, such as clothing products, or any other substrates to which printing inks are applied, energy losses stem from direct radiation upon the oven chamber surfaces other than the belt and printed textile per se. Energy loss can also be significantly encountered where the heat escapes from the oven enclosure, such as at its entrance or exits, during usage. Losses also occur through conduction of the heat through the materials in contact with the heating elements, such as brackets and even insulation on the backside of the elements. In the case of today's gas fired ovens, energy losses come primarily from energy wasted heating of the plenum(s) leading to the diffuser(s) above the printed textile. In both cases, there are oven chamber surfaces heated that do not contribute to the curing of the printed textile, and they are the primary sources for measurable energy loss. This is an expensive energy loss to the business owner.

Printers use a wide variety of inks requiring different curing temperatures and schedules. Inks and coatings manufacturers generally only show one curing schedule. Printers, however, must consider cure-time schedules under different time-temperature conditions to optimize space, equipment, and process, minimize cost, and assure that the finished products meet the specifications set in place for quality control and by the end user. It is understood in the industry that more consistent ink cross linking, textile adhesion, and wash fastness comes from controlled heat transfer with longer dwell times. Dwell time is defined as the time the product is in the oven chamber. It must be sufficient to bring the thickness of the ink layer through its cure temperature, without over-heating the ink or substrate.

It is also important to note that a longer oven chamber can lengthen the dwell time and/or increase the production rate. A disadvantage of today's oven designs and their horizontal orientation is the additional equipment cost, energy loss, and energy consumption associated with buying a longer oven chamber. To compensate, some newer oven designs have shorter oven chambers and higher wattage radiant heating elements or higher BTU gas burners. This is not a better solution. Production rates are inflated, more energy is consumed, and curing quality is sacrificed.

Examples of various structures and functioning for curing ovens, even for clothing products, such as shirts, can be seen in the following prior art patents. For example, U.S. Pat. No. 4,028,051 shows a Curing Oven for Mineral Wool.

U.S. Pat. No. 4,603,491, to Hengle, et al, shows a Reversible Cross Flow Drying or Curing Oven.

The patent to Salisbury, et al, U.S. Pat. No. 4,694,180, shows a Curing Oven for Adhesive.

The patent to Kersting, U.S. Pat. No. 4,717,339, shows what appears to be a rack style of Curing Oven.

The patent to Cornell, U.S. Pat. No. 4,825,561, shows a Curing Oven Apparatus, apparently for curing items in a flat or horizontal arrangement.

The patent to Braun, U.S. Pat. No. 5,018,966, shows a Strip Drying or Curing Oven. This particular device apparently shows in inline style of curing oven, where the items enter one end, and exit the other.

The patent to Chang, et al, U.S. Pat. No. 5,033,203, shows a Curing Oven Using Wellsbach Conversion.

The design patent to Neal, Des. 360,423, shows a Screen-print Curing Oven, apparently for drying printed items passing through the heater on a horizontal belt.

The patent to Bishop, et al, U.S. Pat. No. 6,267,587, shows a Thermal Curing Oven and Thermal Curing Process.

The patent to Smith, U.S. Pat. No. 6,394,796, shows a Curing Oven Combining Methods of Heating.

The patent to Rogers, Jr., et al, U.S. Pat. No. 8,038,436, shows another Textile Curing Oven with Active Cooling.

A variety of published applications show various types of textile curing ovens, for bonding adhesives to the back surface of textile articles, as can be seen in the Published Application No. US 2008/0193890, in addition to Published Application No. US 2010/0119985. These are examples of available prior art style of curing ovens, some of them for curing the adhesive, or print, upon textiles.

SUMMARY OF THE INVENTION

This invention relates to the formation of an oven, in combination with a conveying system, wherein textiles, such as shirts, may be conveniently applied, continuously passed by various types of heating systems, in order to cure the applied printed inks, with more efficient curing, less energy consumption, performed by means of a continuous process, and which can be custom designed for the customers needs in order to assure that quality product can be continuously produced at a minimum cost.

The primary object of the oven design and method of this invention is to improve a printer's dwell time for ink curing with minimal energy consumption, as previously stated. A longer oven chamber allows for longer dwell times and/or greater production rates. This is accomplished by changing the orientation of the heat source and the textile to an upright or vertical configuration, as applied to a continuous conveyor system, with the textiles being held upon a hanging chain conveyor system incorporated in proximity with the heating means of the oven design. The chain is conveyed in an efficient manner so that the printed image on the textile is cured by being exposed to both sides of the same radiant heater, or bank of vertically mounted radiant heaters. Using both sides of the radiant heaters minimizes energy loss and increases dwell time without additional energy consumption, and assures that maximum heat is available and applied to the exposed printed inks as previously applied to the conveyed textiles. Hence, exposing the printed textiles to both sides of the heating element actually reduces the amount of energy needed from oven designs previously available in the prior art.

The benefit of the present invention and method is the space saved in relation to existing oven designs, provided by the reduced footprint of the invented oven. Space is valuable to printers and building owners. The businessman's quest is always to add efficiency into the operations of their businesses. For example, a typical screen print oven has equal entry, for loading, and exit, for cooling and unloading, with sections on opposite ends of the oven chamber. The combined length of the entry and exit sections of current ovens usually equal about 75%-100% of the oven chamber. Unique to the preferred embodiment of this invention, due to the usage of the u-turn through the conveyor system of the exposed printed textiles makes the oven construction of a much shorter dimension, in that the entry and exit sections are next to each other, and not on opposite sides or opposite ends of the oven chamber. Thus, the present invention and method can be as much as 20%-40% shorter than the older existing designs, and do not require operators to work on opposite ends of the oven, to undertake its usage. This invention thereby reduces the production work area.

Another feature of this invention is that with the addition of radiant heaters to either side of the oven, in addition to its center, that the radiant heat will be exposed to both surfaces of any textiles/substrates that are passing through the heater. Thus, both the front and the back of the textiles will be exposed to heaters, which is especially beneficial if, for example, a shirt has been imprinted on both sides.

Another benefit of the present invented oven design is the standardized distant from the substrate and the radiant heater face created by the fixed distance of the conveyor chain and its integrated clips, from the radiant heater face. A problem with the horizontal orientation of existent oven designs is the varying distance from the textile to the heat source's face. This occurs because substrates are of different thicknesses and layers, especially when folded and then laid on the belt, change the distance from the printed image to the heat sources face, since the textiles may not typically lay flat. These changing distances from the heat source face can require additional cure testing for differing print jobs because the distance from the printed image and the heat source face will affect the rate of heat transfer and, therefore, the cure schedule. The invented oven and method is, therefore, an improved design with its vertical orientation fixing the distance between the printed image on the textile and its heat source.

Further study of the concept of this invention has determined that the dwell time that the textile or related material being treated through the radiant heaters, for curing purposes, does have the effect of impacting the quality of the ink curing, and it has been determined that the dwell time is closely related to the oven chamber length and the production rate. The oven's general production rate is an oven's throughput over a given period of time. The formula below is an example of an oven's production rate, relative to its dwell time, and the dimensions of the oven chamber. Also having an effect are the dimensions of the product being cured by the heat. The formula is as follows:

$$\text{Products per hour} = 3600/[(L_p \times T_d)/L_c]$$

$L_p$=Product Length (ft)

$T_d$=Dwell Time (seconds)

$L_c$=Oven Chamber length (ft)

It is important to note that the longer oven chamber can lengthen the dwell time and/or increase the production rate. A disadvantage of current oven designs and the horizontal orientation of textile and heat source is the additional equipment cost, energy loss, the energy consumption associated with buying a longer oven chamber. In addition, since the textiles in previous oven designs are generally laid horizontally upon a conveyor, they will only be heated upon the upper surface, and that alone. The current invention provides for the transfer of the textile first along one side of the heat chamber, and then turns it for passage along another side of the heat chamber, and since, as previously summarized, it may be possible to have a heater in the center, and two on either side of the chamber, continuous curing in a much shorter length oven can be attained.

Yet another benefit of the present invention is the endless routing possibilities of a chain conveyor. When we speak of a chain conveyor, we mean a conveyor that may be fabricated of different materials, but generally forms a conveyor system to which the textiles may be vertically suspended through the oven by specially designed and automatically operating clips. Depending upon the type of chain used, the track and chain conveyor system can be cost efficient when routed and installed to stretch different lengths and elevations to accommodate more than one printing press. This can allow a production floor designer to connect the printing, curing, and packaging stations/cells of his facility more easily than the traditional horizontally oriented conveyor ovens. Space, labor, and curing equipment can then be saved by efficiently routing the track and chain conveyor system, custom designed to meet the individual customer's needs.

These and other objects may become more apparent to those skilled in the art upon review of the summary of the invention as provided herein, and upon undertaking a study of the description of its preferred embodiments, in view of the drawings.

DESCRIPTION OF THE PREFERRED EMBODIMENT

Figure 1:
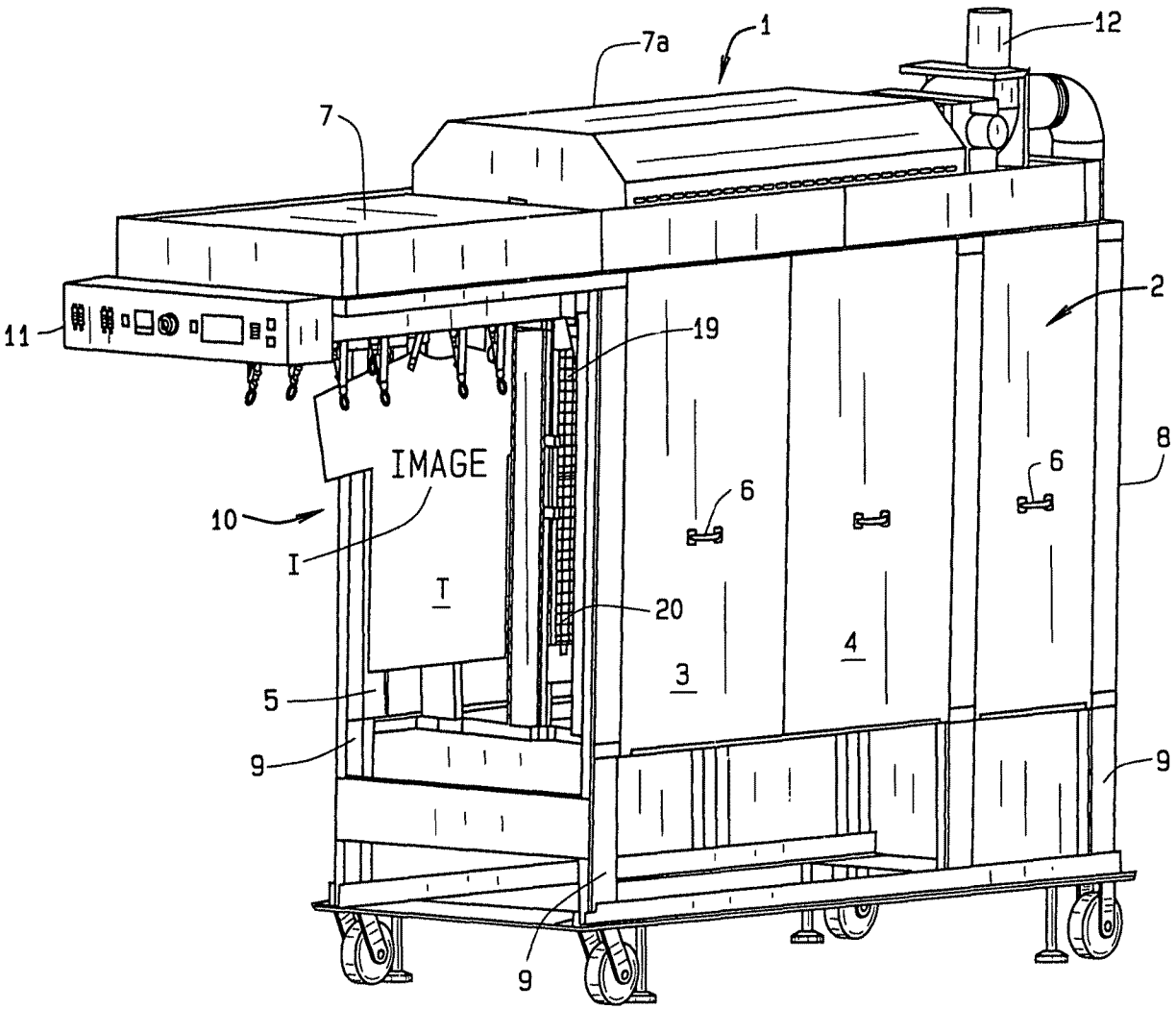
FIG. 1 is an isometric view of one embodiment of the curing oven for printed textiles of this invention.

In referring to the drawings, and in particular FIG. 1, therein is shown the overall structure for the curing oven for printed textiles 1 of this invention. It generally includes an enclosure 2 that includes various side walls 3 and 4, and others, and which side walls may have insulating panels, even in the form of doors, as at 5, applied therein in order to conserve the heat generated within the oven during its operations. Various handles may be provided upon the side walls or doors, as at 6, to facilitate their shifting, movement, replacement, as may be necessary.

There is a top wall 7, and a back wall 8 provided for the oven structure. As can be seen, there are various vertical framework 9 provided throughout the structure, and integrated together into a structural framework, for holding the various walls, and the operating components of the oven, when assembled. The framework may even be wheeled, as noted.

In this particular embodiment, it can be seen that the front end of the structure, as at 10, is opened, in order to allow free access by the worker to the interior of the oven, for applying the various printed textiles, as at T, to the conveyor clips, in preparation for their passage through the oven, or for their removal, after heat curing. The textile will have an indicia I applied to it, as can be noted. The front of the structure includes a control panel 11 that has the various operating controls for the oven, such as establishing the generated heat, the speed of the conveyor, and any of the other controls necessary for operations of the oven.

While the location and structure of the conveyor system provided within the curing oven is not clearly shown in FIG. 1, there is disclosed a motor 12 that is used for regulating the speed of operations of the oven conveyor system, that regulates the speed of movement of the vertically suspended substrates through the oven during performance of a curing process. Generally, a dc motor will be used because its speed can be varied, through the control panel, to determine the speed at which the textiles move through the oven, during usage.

As can also be seen in FIG. 1, there may be supplementary means provided upon the upper surface of the oven structure, such as lighting, supplemental heating, or even a ventilation system, as noted at 7A.

Figure 2A:
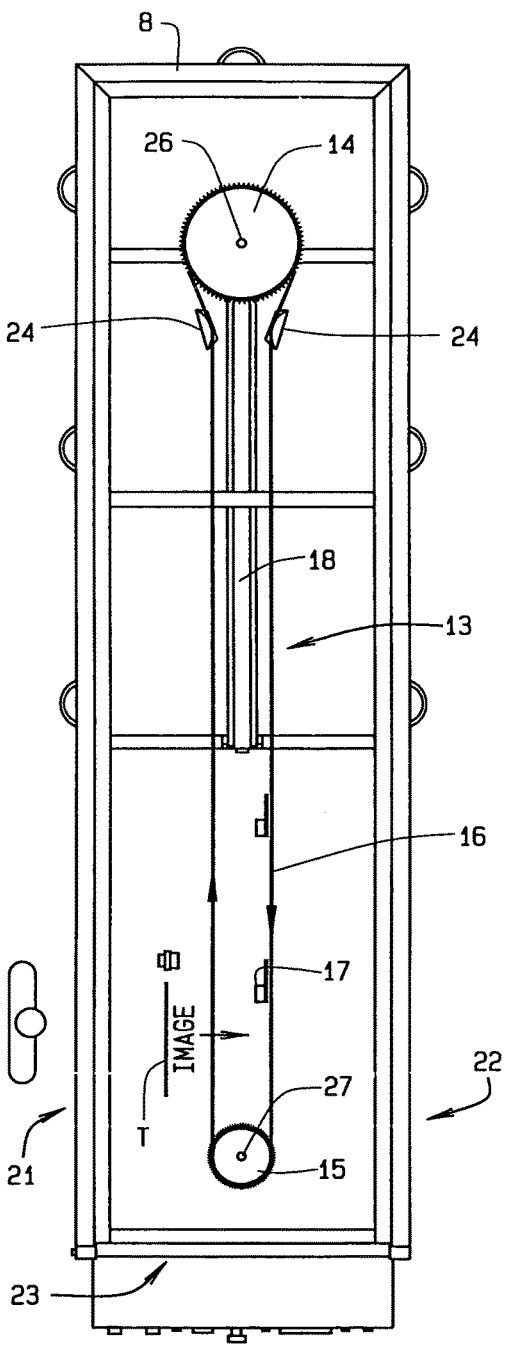
FIG. 2A provides a sectional plan view, showing the curing oven below its top wall, and the continuous conveyor system provided for passing the printed textiles along both the opposite faces of the arranged heating elements of the curing oven.

FIG. 2A shows a top plan view, with the top wall 7 removed, and shows the conveyor system 13 assembled within the oven, for usage. As can be noted, there are a pair of sprockets 14 and 15, which holds the conveyor means 16, which in this particular instance, may comprise a hanging chain type conveyor system, or other track system, that holds a series of clips, as noted at 17, and while only two such clips are shown, there may be a set of clips provided, spaced at various intervals, entirely around the system, for holding a plurality of substrates in place for continuous movement through the oven, during a printing ink curing cycle. As also noted within the assembled structure, and particularly within the enclosed portions of the oven, there are the heating elements 18, which as noted, are located intermediate the continuous conveyor 13, and the advantages of this arrangement is that when, for example, a substrate T is applied to the conveyor, and suspended vertically, as noted in FIG. 1, its printed image I will always face at least one side of the heating elements, as the shirt passes down the incoming side of the conveyor, goes around the sprocket 14, and returns on the opposite side of the heating elements 18, so that efficiency is achieved through the exposure of the printed textile to both sides of the heating elements, to assure that proper curing of the ink takes place.

As can be seen in FIG. 1, the heating elements may be stacked, one above the other, as noted at 19 and 20, so as to provide a full exposure of the printed pattern to the surfaces of the heating elements, to assure that proper ink curing takes place.

While the heating elements have been generally described as comprising radiant heaters, as in the description of the preferred embodiment, it is likely that other forms of heating could be used, vertically stacked as noted, such as BTU gas heaters, high wattage heaters, various infrared heaters, and other types of heating elements that can generate and disseminate a controlled heat, for use for the purposes of this current invention. In addition, it is within the concept of this invention that the various heating elements may also be located proximate the inside surfaces of the various walls 3, 4, etc., of the oven structure, as previously explained, so that the textiles can be cured upon both surfaces, in the event that printing has been done to both sides, during processing of the shirts with indicia, as explained.

Figure 2B:
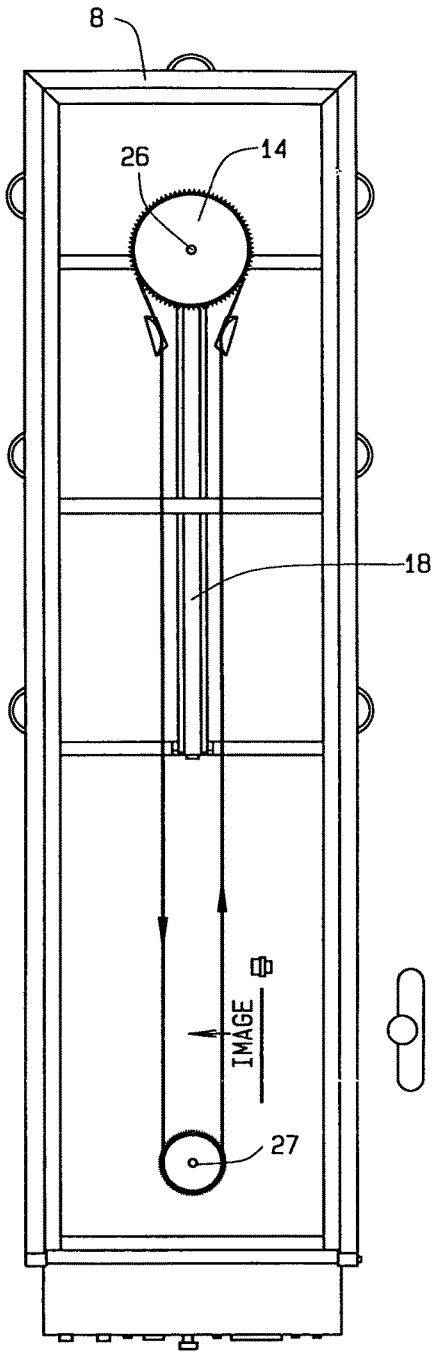
FIG. 2B shows the same view as FIG. 2A, but discloses how the curing oven can be arranged conveniently to allow for loading on an opposite side of the oven of FIG. 2A, that may meet the conditions and requirements for the plant in which the curing oven is installed.

Also, as can be seen in FIG. 2A, in addition to FIG. 2B, the loading and unloading areas, as at 21 and 22 may also include panels, or side walls, such as doors, and can be arranged so that loading may take place on one side, as noted, and unloading on the other side, after the textiles have moved through the heating process. FIG. 2B shows how loading and unloading can be reversed, depending upon the custom design of the oven for the customer's location. And, the various wall panels 3 or 4 can be readily removed, to allow access into the oven, for loading and unloading purposes, as can be readily understood.

There may even be under certain circumstances another end wall provided at the loading end of the device, as noted at 23, with the inclusion of all these various walls to the structure of the device provided generally for maintaining heat retention, within the oven, so as to increase its efficiency of operations, and reduce energy loss, in order to reduce the expense of operations of the oven.

Also, the variations upon the usage of the oven design as shown and described herein, where loading and unloading can be reversed, where the oven may be lengthened with additional heating elements, or where conveyors external to the oven can be routed to different areas of the facility. But, essentially, the concept is to orient the curing system into a more vertical arrangement, where the textiles can be applied to an endless conveyor, and pass the textiles around emplaced heating elements. You can also note that there is a tensioning sprocket 24 that is applied biasing against the chain conveyor in order to keep it under tension during its movement during usage.

FIG. 3 shows the various styles of clips 17, and their functioning, in combination with the chain or other conveyor, to hold the textiles or substrates in place, as they pass through the heater arrangement.

Essentially, there is at least one caming mechanism 25 that is rigidly fixed to the structure of the device, such as any one of its longitudinal rails, in the upper region of the oven. The same type of structure is used to hold the rotating shafts 26 and 27, which are used to hold the sprockets and the conveyor chain in place. The cam members 25 are rigidly fixed to the upper supporting structure, and in alignment with the conveyor chain 16, so that as the clips, as at 17, are moved by the conveyor system 13, these clips bias against the cam surface 28, and are forced into opening, so that the textiles can be automatically released after completion of a curing operation. As can be seen, each of these clips 17 has at least one or more spring biased levers, as at 29, and as the conveyor chain 13 pulls the clip along the conveyance system, each clip, at its upper end, as noted at 30 (see FIG. 3D) biases against the earning edge 28 of the cam 25, and forces the clip inwardly, as noted at 31 in FIG. 3E, and opens the bottom of the clip, as at its lever 32, so that a textile may be released. There is also the option that there may be two clips 17 provided, and the cam 25 will urge one clip opened, in the manner as explained at 32, while the second clip 17 may remain closed, until such time as the earning edge 28 engages the upper end 30 of that clip, to force it open, for insertion or release of the textile.

Figure 3A:
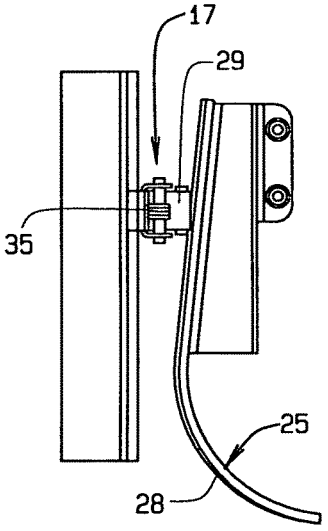
FIG. 3A shows one of the clips applied to the conveyor means or chain used in the curing oven, and how they can be automatically manipulated between opened and closed positions, for holding textiles, through the use of an operative cam.
Figure 3B:
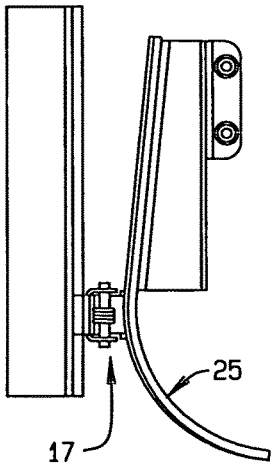
FIG. 3B shows one of the clips, in top view, disclosing how the initial clip has been opened by encountering its associated cam, before its second clip encounters the same.
Figure 3C:
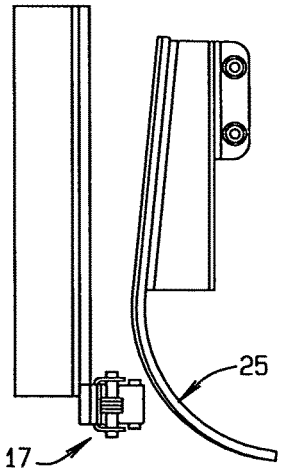
FIG. 3C shows how the clip for holding the textiles has its frontal clip closed for holding a textile, while its second clip is forced into an opened position through encountering of the associated cam means.
Figure 3D:
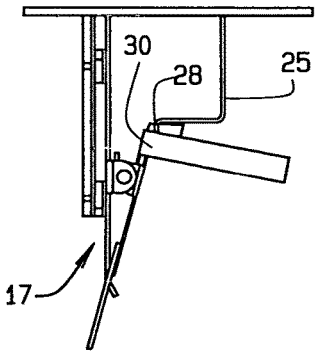
FIG. 3D provides an end view of the clip before it encounters the caming surface, as also shown in FIG. 3A.
Figure 3E:
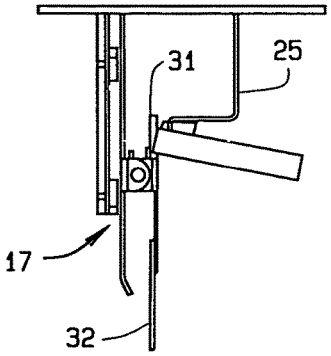
FIG. 3E shows the caming surface encountering the initial clip, as shown in FIG. 3B, to attain its opening for releasing of a substrate upon exiting the oven.
Figure 3F:
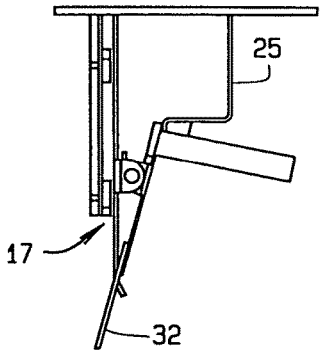
FIG. 3F shows how the second clip, of FIG. 3C, encounters the caming surface of the oven structure, and is opened, while the first clip is biased closed for holding a textile in place, in preparation for passage through the curing oven.

Passage of the clip 17 upon the chain conveyor 13 past the cam 25, where it biases the initial clip 17 into an opened configuration, but has not as yet engaged the upper edge of a second clip. In addition, where the chain conveyor has moved the clip 17 further along, it clears the cam as can be seen in FIG. 3C. This arrangement of the various clips are arranged within the structure of a singular clip as what is shown for the preferred embodiment of this invention. Hence, the sleeve of one shirt may be held by one clip, as the clip passes thereby, and the next shirt to be installed onto the conveyor system may have one of its sleeves secured by another clip, in preparation for its movement through the curing oven. Obviously, the other sleeves of the two respective shirts will be held by the lever of the next adjacent clip, as it is moved along the path of the conveyor system. This provides an example as to how the conveyor system, embodied within the structure of the curing oven, can be automated, so as to lessen the manual participation in the release of textiles that exit the oven, since the clips are automatically opened by the caming system 25. As can also be seen in FIGS. 3A, B and C, there are various spring biasing means 35 that bias each of the clip levers into closure, after they bypass the cam means 25.

As previously reviewed, the concept of this invention is to automate the operations of a curing oven, and orient the textiles, materials, and clothing, such as shirts, locating them in a vertical direction, clipping them for passing by the radiant heaters, on both sides, to assure that maximum curing takes place, in a minimum of time, in a much lesser space requirement, because both sides of the heater are used for directing radiating heat onto the printed surfaces of the substrates, as they pass through the oven curing system of this invention.

Variations or modifications to the subject matter of this invention may occur to those skilled in the art upon review of the disclosure as provided herein. Such variations, if within the spirit of this invention, are intended to be encompassed within the scope of any claims to patent protection issuing herein. For example, the curing oven may also embody its own exhaust system, for eliminating any excessive heat that may be generated, or to exhaust heat from the system, at the conclusion of a curing operation. Generally, the description of the preferred embodiment, and as depicted in the drawings, is set forth for illustrative purposes only.

We claim:

1. A curing oven for conveying printed substrates past at least one heater to attain a curing of applied printed ink, comprising:

a structured oven framed of a series of side walls, at least one end wall, and a top and bottom wall, said structured oven incorporating framework to hold said walls together;

a conveyor provided upwardly within the oven and supported by said framework, said conveyor being of continuous design and structured and provided for holding printed textiles in a vertical position as the textiles are conveyed through said structured oven;

said conveyor being of a longitudinal length, and at least one heater provided within the structured oven and arranged longitudinally partially along a length and within the said conveyor, and arranged vertically approximately centrally of a continuous conveyor;

whereby upon movement of the printed textiles as vertically suspended from said continuous conveyor the printed textiles are exposed to at least one side of the heater to achieve a curing of printed ink previously applied to the printed textiles;

a caming mechanism; and a clip for holding one of the printed substrates when the printed substrate is being moved by the conveyor, the clip for releasing the printed substrate when contacting the caming mechanism upon completion of a curing operation.

2. The curing oven of claim 1 and provided for curing the printing ink applied to substrates as moved by the continuous conveyor and exposed along both sides of the heater during a curing operation.

3. The curing oven of claim 1 wherein a plurality of heating units, and said heating units are approximately vertically mounted radiant heaters.

4. The curing oven of claim 3, where a plurality of vertically and aligned mounted radiant heaters forming the heating unit for the curing oven.

5. The curing oven of claim 1 wherein the continuous conveyor is a chain conveyor that supports the printed textiles during their movement through the curing oven.

6. The curing oven of claim 1 further comprising a series of clips applied to a chain conveyor, said clips provided for holding the printed substrates during its movement through the curing oven.

7. The curing oven of claim 1, wherein the curing oven may be exhausted.

8. The curing oven of claim 1, wherein the clip may be manually operated when the printed substrate is applied for passing through the curing oven, and for the the automatic release when the substrate has passed through the curing oven during a curing operation.

9. The curing oven of claim 8, wherein the earning mechanism comprises a cam surface provided upwardly within the curing oven and connecting with the framework, said cam surface being arranged in alignment with the clip to provide for the the mechanical opening as the clip passes by the cam surface when the conveyor conveying the printed substrates through the curing oven.

10. The curing oven of claim 9, wherein the clip includes a pair of spring biased levers, and one of said levers capable of being biased by the cam surface into an opened position for releasing a printed textile from the continuous conveyor, during operations.

11. The curing oven of claim 1, and wherein at least a pair of sprockets are provided within the framework of the curing oven, each sprocket provided for holding the continuous conveyor for movement, and a motor means operatively associated with one of the sprockets to provide for movement as the continuous conveyor passes the printed textiles past the heater during operations of the curing oven.

12. The curing oven of claim 11, wherein said motor is a variable direct current motor.

13. The curing oven of claim 11, and including a control panel, supported by the framework, and displaying the various controls for regulating a degree of heat generated by the heater, in addition to controlling speed of the motor when moving the continuous conveyor during usage.

14. The curing oven of claim 1 wherein the heater comprises a plurality of radiant heaters arranged centrally aligned within an arranged conveyor to cure the printed substrates on one side of conveyor suspended textiles, and a series of heaters provided against an interior of said side walls to cure the textiles on other sides.

15. The curing oven of claim 1 wherein said conveyor extends outside of the structured oven to facilitate application and removal of the textiles therefrom.

* * * * *